US012043294B2

(12) United States Patent
Kronabeter et al.

(10) Patent No.: US 12,043,294 B2
(45) Date of Patent: Jul. 23, 2024

(54) GAP BRIDGING SYSTEM

(71) Applicant: Siemens Mobility Austria GmbH, Vienna (AT)

(72) Inventors: Martin Kronabeter, Freundorf (AT); Florian Eder, Sommerein (AT)

(73) Assignee: SIEMENS MOBILITY AUSTRIA GMBH, Vienna (AT)

( * ) Notice: Subject to any disclaimer, the term of this patent is extended or adjusted under 35 U.S.C. 154(b) by 829 days.

(21) Appl. No.: 16/612,233

(22) PCT Filed: May 7, 2018

(86) PCT No.: PCT/EP2018/061697
§ 371 (c)(1),
(2) Date: Nov. 8, 2019

(87) PCT Pub. No.: WO2018/206493
PCT Pub. Date: Nov. 15, 2018

(65) Prior Publication Data

US 2021/0155272 A1 May 27, 2021

(30) Foreign Application Priority Data

May 11, 2017 (AT) ..... A 50386/2017

(51) Int. Cl.
*B61D 23/00* (2006.01)

(52) U.S. Cl.
CPC ..... *B61D 23/00* (2013.01)

(58) Field of Classification Search
CPC ..... B61D 23/00; B61D 23/025; B60R 3/02; A61G 3/061; A61G 3/067; B60P 1/431
See application file for complete search history.

(56) References Cited

U.S. PATENT DOCUMENTS 4,090,452 A * 5/1978 Segar ..... B60M 1/30 104/130.01
5,636,399 A * 6/1997 Tremblay ..... A61G 3/061 14/71.1
5,832,555 A * 11/1998 Saucier ..... B60P 1/431 14/71.1
7,308,978 B2 * 12/2007 Matheisl ..... B66B 23/12 198/330
2010/0294848 A1 * 11/2010 Bullis ..... B60B 17/0072 238/3

FOREIGN PATENT DOCUMENTS

CN 103010240 4/2013
CN 105882537 8/2016
(Continued)

OTHER PUBLICATIONS

International Search Report based on PCT/EP2018/061697 dated Aug. 3, 2018.

*Primary Examiner* — S. Joseph Morano
(74) *Attorney, Agent, or Firm* — Cozen O'Connor

(57) ABSTRACT

A gap bridging system for a rail vehicle, for bridging the gap between the floor of a passenger compartment and a station platform, includes a component support and a step plate which is mounted with respect to the component carrier by a slide mounting such that it can slide, the slide mounting includes a rolling bearing linear guide and two sliding bearing linear guides.

2 Claims, 4 Drawing Sheets

(56) References Cited

FOREIGN PATENT DOCUMENTS

| | | | |
|---|---|---|---|
| CN | 106285059 | | 1/2017 |
| DE | 19928571 | | 1/2001 |
| DE | 19928571 | C2 | 5/2001 |
| DE | 202009004004 | | 8/2010 |
| DE | 102014113423 | | 3/2016 |
| EP | 0578574 | | 1/1994 |
| WO | WO2008040138 | | 4/2008 |

* cited by examiner

GAP BRIDGING SYSTEM

CROSS-REFERENCE TO RELATED APPLICATIONS

This is a U.S. national stage of application No. PCT/EP2018/061697 filed May 7, 2018. Priority is claimed on AT Application No. A50386/2017 filed May 11, 2017, the content of which is incorporated herein by reference in its entirety.

BACKGROUND OF THE INVENTION

1. Field of the Invention

The invention relates to a gap bridging system for the gap between a passenger compartment floor of a rail vehicle and a platform.

2. Description of the Related Art

Gap bridging systems are used in modern rail vehicles to enable passengers, especially people with restricted mobility, to board and alight comfortably and in particular in order to minimize the danger posed by the gap between the passenger compartment floor and the platform. This gap has a width of approximately 100 mm in typical rail vehicles (for example, subway trains), but can also amount to as much as 300 mm on platforms in track curves, for example. This platform gap can be bridged by sliding steps, which comprise a plate that is mounted such that it can slide and which can be slid out of the vehicle with power assistance. Because it is desirable here for such gap bridging systems to take up as little space as possible, they must be constructed with a minimum possible vertical extent so as to avoid impairments to the floor in the door region. Sliding steps are however subject to strong mechanical stresses because, in addition to the vertical and horizontal forces applied by passengers, twisting of the car body can also lead to reactive forces on the gap bridging systems. The primary objective of the design of such a gap bridging system is that it never fails when acted on by the expected forces and in particular does not tend to tilt, even when forces are applied asymmetrically. For example, a step plate of a sliding step must extend and retract safely even when the vehicle is fully loaded. According to the prior art, this is achieved through the use of ball or roller guide elements with correspondingly high load capacities. However, because these guide elements can require a large installation space, they can be replaced by a larger number of guide elements each with a lower load capacity, although this renders it difficult to arrange further components of a gap bridging system, such as drive units or control electronics. When designing a guide of a step plate, it is also necessary to ensure that either a fixed bearing or a floating bearing is inserted at the appropriate position in each case, because otherwise construction tolerances or twisting of the car body or the housing of the gap bridging system result in a tilting of the step plate.

SUMMARY OF THE INVENTION

In view of the foregoing, it is therefore an object of the invention to provide a gap bridging system having a lowest possible installation height with a high level of resilience.

This and other objects and advantages are achieved in accordance with the invention by a gap bridging system for a rail vehicle for bridging the gap between a passenger compartment floor and a platform, which comprises a component carrier and a step plate that is mounted with respect to the component carrier by a slide mounting such that it can slide, where the slide mounting comprises a rolling bearing linear guide and two sliding bearing linear guides.

The advantage that can be achieved thereby is that a slide mounting for a step plate of a gap bridging system can be fitted, which requires less installation space than conventional slide mountings. The combination of sliding and rolling bearing linear guides makes it possible to exploit the specifically higher load capacities of sliding bearings to achieve a gain in terms of installation space.

Here, the one rolling bearing linear guide is preferably formed as a fixed bearing, which transmits forces between the step plate and the component carrier in each spatial direction oriented at right angles to the movement direction of the step plate. Here, the sliding bearing linear guides are to be formed as floating bearings, which transmit forces between the step plate and the component carrier in a vertical direction only (relative to a gap bridging system in the installation position). As a result, it is possible to securely prevent a tilting of the step plate, irrespective of the spatial direction in which forces act on the step plate.

In a preferred embodiment of the invention, the sliding bearing linear guides are arranged on the outer ends of the step plate in the movement direction of the step plate, and the rolling bearing guide is arranged centrally between the sliding bearing linear guides. As a result, it is possible to achieve the advantage that a tilting of the step plate can be prevented in an optimal manner, because the reactive forces caused by asymmetrical loads are minimized on account of the central arrangement of the fixed bearing.

In practical embodiments of the invention, it can be advantageous to configure the sliding bearing linear guides formed as floating bearings such that, similarly to the rolling bearing linear guide, they also transmit horizontal forces between the step plate and the component carrier when certain horizontal forces are applied to the step plate. This can be achieved via a suitable sliding guide with horizontal plays coordinated with the rolling bearing linear guide. As a result, the sliding bearing linear guide in the extended position can transmit high vertical forces to the step plate while taking up little installation space and, when horizontal forces are applied, can relieve the rolling bearing linear guide from the transmission of these forces.

The component carrier forms a basic unit of the gap bridging system on which the further components, such as the slide mounting for the step plate, a drive unit or control devices, are arranged. As a result, a gap bridging system can be produced as a distinct, separate component that is attached to the car body during final assembly of a rail vehicle.

In the retracted position (idle position) of the step plate, only weight forces and reactive forces caused by vehicle accelerations and vibrations act on the sliding guide. During the extension movement, reactive forces in the slide mounting can occur, for example, in the event of an asymmetrical contact of the front edge of the step plate with a platform (for example, where a platform is arranged in a curve). The arrangement of two lateral floating bearings and a centrally arranged fixed bearing makes it possible to reliably prevent a tilting of the slide mounting and thus a jamming of the step plate.

Other objects and features of the present invention will become apparent from the following detailed description considered in conjunction with the accompanying drawings. It is to be understood, however, that the drawings are designed solely for purposes of illustration and not as a definition of the limits of the invention, for which reference should be made to the appended claims. It should be further understood that the drawings are not necessarily drawn to scale and that, unless otherwise indicated, they are merely intended to conceptually illustrate the structures and procedures described herein.

BRIEF DESCRIPTION OF THE DRAWINGS

The invention is explained below based on exemplary embodiments and with reference to the figures in the drawings, in which.

DETAILED DESCRIPTION OF THE EXEMPLARY EMBODIMENTS

Figure 1:
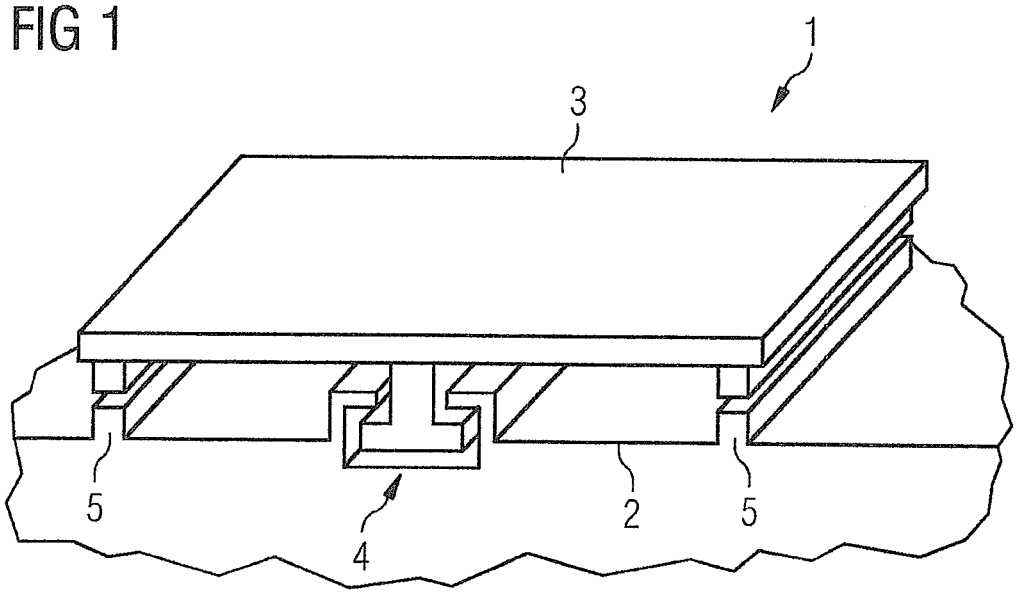
FIG. 1 shows a principle of a gap bridging system in accordance with the invention.

FIG. 1 shows by way of example and schematically a principle of a gap bridging system. A highly abstract oblique representation of a gap bridging system 1 is shown, which comprises a step plate 3 mounted such that it can slide linearly. This step plate 3 is mounted via a slide mounting comprising two sliding bearing linear guides 5 and a rolling bearing linear guide 4 such that it can slide. Here, the sliding bearing linear guides 5 are formed as floating bearings and transmit forces between the step plate and a component carrier 2 or a car body only in the vertical direction. The rolling bearing linear guide 4 transmits forces between the step plate and a component carrier 2 in all spatial directions with the exception of the extension direction of the step plate 3. The gap bridging system 1 comprises, in addition to the step plate 1 and the linear guides 4, 5, a component carrier 2 via which the gap bridging system 1 can be connected to a car body of a rail vehicle.

Figure 2:
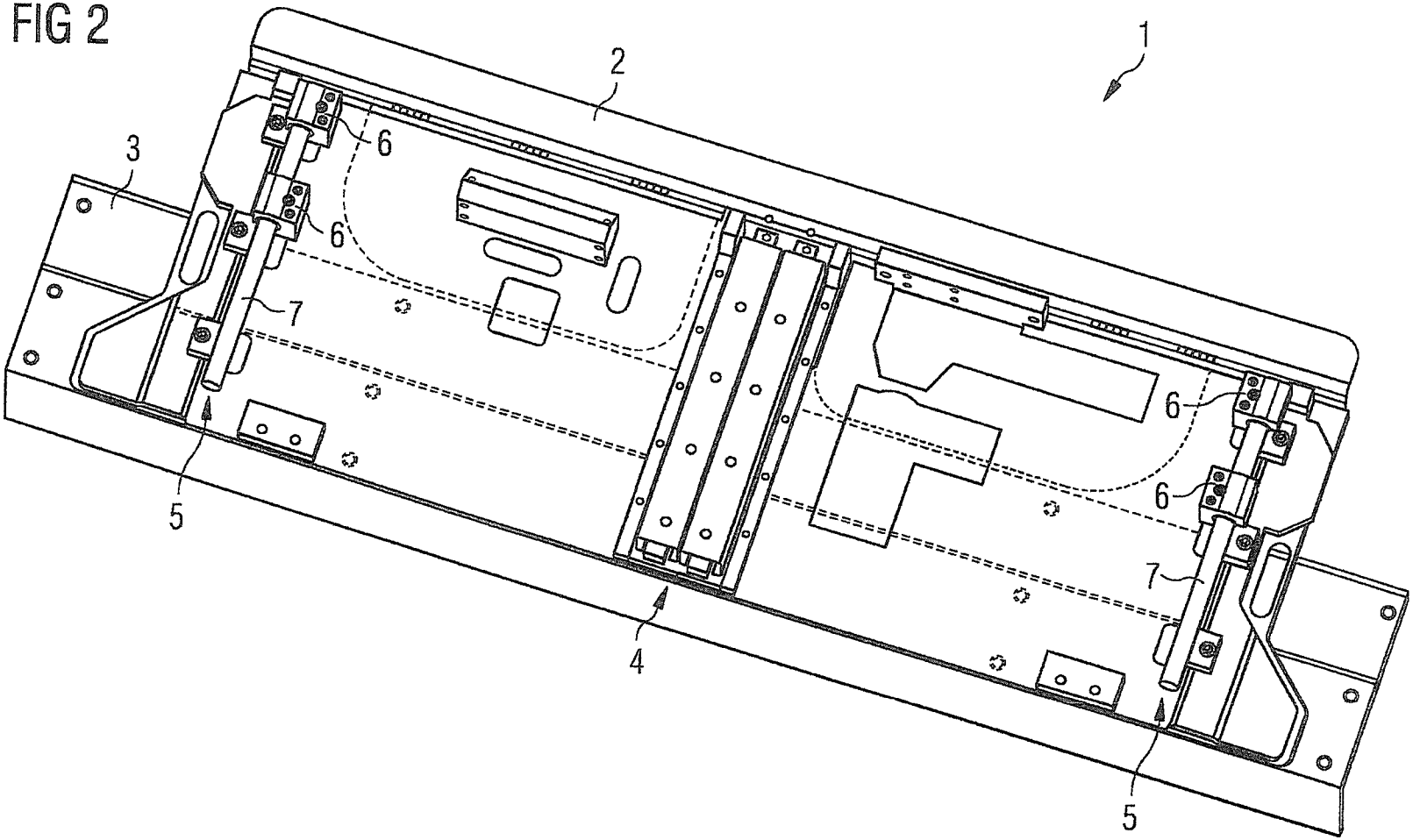
FIG. 2 shows an oblique view 1 of the gap bridging system of FIG. 1.

FIG. 2 shows by way of example and schematically a gap bridging system in a first oblique view. A practical embodiment of a gap bridging system 1 in an installation situation in a rail vehicle is represented. Here, to illustrate the function clearly, the step plate 3 is represented such that it does not conceal the further components of the gap bridging system 1. In this way, it is possible to see inside the slide mounting. The gap bridging system 1 comprises a component carrier 2 upon which, in addition to two sliding bearing linear guides 5 and a rolling bearing linear guide 4, attachment points for a power drive and further components are provided. The gap bridging system 1 can be connected via the component carrier 2 to a car body of a rail vehicle. In the exemplary illustrated embodiment, the sliding bearing linear guides 5 are formed as a sliding guide with a guide rail 7 and two sliders 6 which slide along the guide rail 7, where sufficient play is provided between the guide rail 7 and the sliders 6 to enable the sliding bearing linear guides 5 to perform their function as floating bearings.

Figure 3:
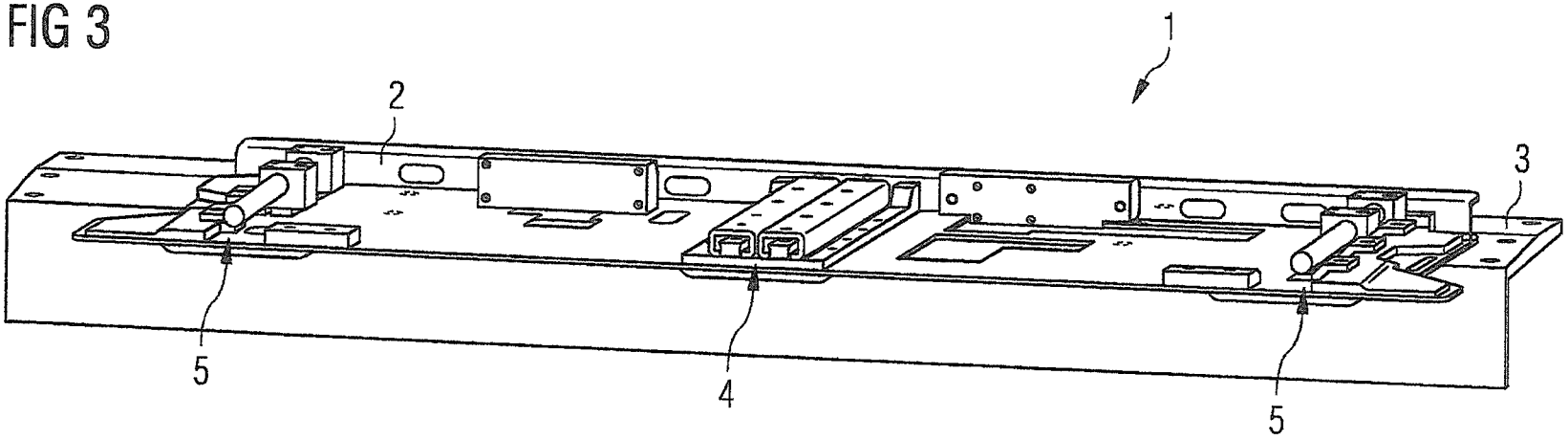
FIG. 3 shows an oblique view 2 of the gap bridging system of FIG. 1.

FIG. 3 shows by way of example and schematically a gap bridging system in a second oblique view. The gap bridging system 1 from FIG. 2 is represented in another oblique view, where in the embodiment of the centrally arranged fixed bearing as the rolling bearing linear guide 4 is particularly visible. This rolling bearing linear guide 4 enables the step plate 3 to slide with as little play as possible, where the sliding bearing linear guides 5 transmit the vertical forces acting on the step plate 3 to the component carrier 2 and subsequently to a car body.

Figure 4:
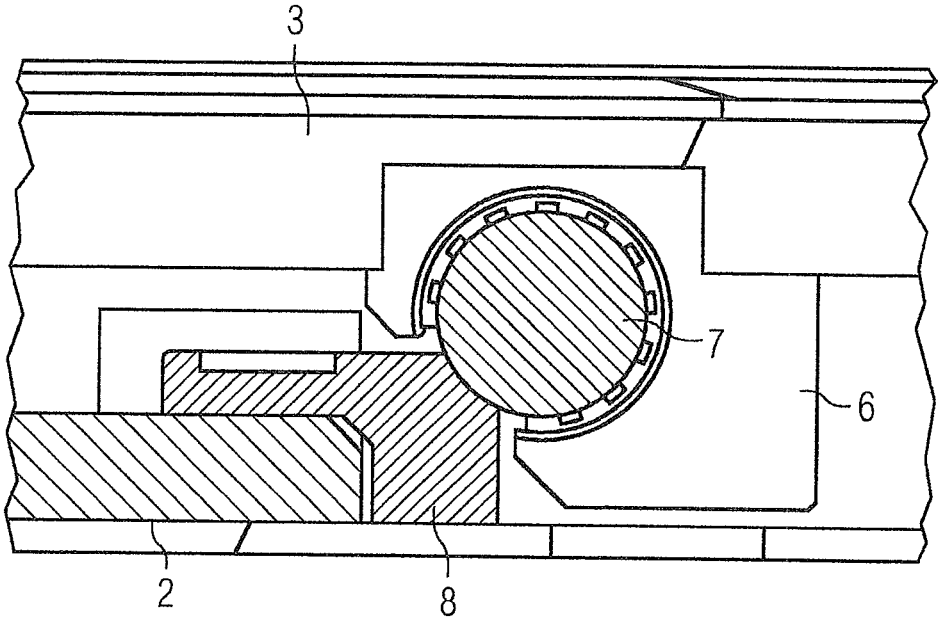
FIG. 4 shows a floating bearing in accordance with the invention.

FIG. 4 shows by way of example and schematically a floating bearing. A sectional view through one of the two sliding bearing linear guides 5 of a slide mounting as in FIGS. 2 and 3 is shown. A guide rail 7 is connected via a retainer 8 firmly to the component carrier 2. A slider 6 surrounds the guide rail 7 through approximately 270 degrees, so that the retainer 8 is connected to the guide rail 7 in the remaining angular range. The hole of the slider 6 that surrounds the guide rail 7 is configured such that there is a horizontal play of sufficient magnitude to enable a deformation of the step plate 3 or the component carrier 2 without this generating reactive forces between the step plate 3 and the component carrier 2, with the sliding bearing linear guide 5 thus acting as a floating bearing. The illustrated embodiment of a floating bearing in the form of a sliding bearing linear guide 5 is formed such that, when a certain force acting horizontally on the step plate 3 is exceeded, it absorbs this force in the same way as the rolling bearing linear guide 4 and thus relieves the rolling bearing linear guide 4. To this end, the plays in the rolling bearing linear guide 4 and the guiding of the sliders 6 on the guide rail 7 must be coordinated with one another such that the floating bearing also transmits horizontal forces only once certain horizontal forces and corresponding deformations of the component have been exceeded.

Thus, while there have been shown, described and pointed out fundamental novel features of the invention as applied to a preferred embodiment thereof, it will be understood that various omissions and substitutions and changes in the form and details of the devices illustrated, and in their operation, may be made by those skilled in the art without departing from the spirit of the invention. For example, it is expressly intended that all combinations of those elements and/or method steps which perform substantially the same function in substantially the same way to achieve the same results are within the scope of the invention. Moreover, it should be recognized that structures and/or elements shown and/or described in connection with any disclosed form or embodiment of the invention may be incorporated in any other disclosed or described or suggested form or embodiment as a general matter of design choice. It is the intention, therefore, to be limited only as indicated by the scope of the claims appended hereto.

The invention claimed is:

1. A gap bridging system of a rail vehicle for bridging a gap between a passenger compartment floor and a platform, comprising:

a component carrier; and a step plate which is mounted with respect to the component carrier by a slide mounting such that said step plate is slidable within the rail vehicle;

wherein the slide mounting includes a rolling bearing linear guide and two sliding bearing linear guides;

wherein the rolling bearing linear guide comprises a fixed bearing, which transmits forces between the step plate and the component carrier in each spatial direction oriented at right angles to the movement direction of the step plate; and wherein the sliding bearing linear guides comprise floating bearings.

2. The gap bridging system for a rail vehicle as claimed in claim 1, wherein the sliding bearing linear guides are arranged on outer ends of the step plate in a direction of movement of the step plate and the rolling bearing linear guide is arranged centrally between the sliding bearing linear guides.

* * * * *